US006484820B1

(12) United States Patent
Tibussek et al.

(10) Patent No.: US 6,484,820 B1
(45) Date of Patent: Nov. 26, 2002

(54) METHOD AND DEVICE FOR DRIVING BORE-HOLES, ESPECIALLY IN THE SEA BED, USING A GUIDE TIP

(75) Inventors: Fritz Tibussek, Monchengladback (DE); Hermann-Josef Von Wirth, Titz (DE)

(73) Assignee: Wirth Maschinen-Und Bohrgeraete Fabrik GmbH, Erkelenz (DE)

( * ) Notice: Subject to any disclaimer, the term of this patent is extended or adjusted under 35 U.S.C. 154(b) by 0 days.

(21) Appl. No.: 09/355,354

(22) PCT Filed: Nov. 25, 1997

(86) PCT No.: PCT/DE97/02754

§ 371 (c)(1),
(2), (4) Date: Sep. 27, 1999

(87) PCT Pub. No.: WO98/32951

PCT Pub. Date: Jul. 30, 1998

(30) Foreign Application Priority Data

Jan. 28, 1997 (DE) ..... 197 02 983

(51) Int. Cl.[7] ..... E21B 7/128; E21B 4/08

(52) U.S. Cl. ..... 175/62; 175/7; 175/325.1; 175/10; 166/355

(58) Field of Search ..... 166/355; 175/6, 175/7, 10, 62, 321, 325.1

(56) References Cited

U.S. PATENT DOCUMENTS

| | | | | | |
|---|---|---|---|---|---|
| 2,994,389 | A | * | 8/1961 | Bus, Sr. | 175/321 |
| 3,277,972 | A | | 10/1966 | Lagerstrom et al. | 175/399 |
| 3,319,726 | A | * | 5/1967 | Brown | 175/5 |
| 3,389,758 | A | * | 6/1968 | Buhler | 175/104 |
| 3,500,678 | A | * | 3/1970 | Van Romondt Vis | 73/84 |
| 3,631,932 | A | * | 1/1972 | Lindelof | 175/6 |
| 3,635,295 | A | * | 1/1972 | Cobbs | 175/257 |
| 3,729,057 | A | * | 4/1973 | Werner | 175/262 |
| 3,732,143 | A | * | 5/1973 | Joosse | 175/6 |
| 3,754,607 | A | * | 8/1973 | Van Daalen | 175/7 |
| 3,782,460 | A | * | 1/1974 | Skinner | 166/338 |
| 3,919,958 | A | * | 11/1975 | Graham et al. | 114/264 |
| 4,572,304 | A | * | 2/1986 | Mahar et al. | 175/5 |
| 5,035,291 | A | | 7/1991 | Shields | 175/5 |

FOREIGN PATENT DOCUMENTS

| | | | | |
|---|---|---|---|---|
| GB | 1068638 | | 5/1967 | |
| GB | 2163465 A | * | 2/1986 | E21B/17/00 |
| GB | 2 163 465 | | 2/1986 | |
| WO | WO 86/04950 | | 8/1986 | |
| WO | WO-8604950 A | * | 8/1986 | E21B/17/00 |
| WO | WO 91/02881 | | 3/1991 | |

* cited by examiner

*Primary Examiner*—David Bagnell
*Assistant Examiner*—Jennifer H Gay
(74) *Attorney, Agent, or Firm*—Foley & Lardner

(57) ABSTRACT

A process and an apparatus for sinking drill holes, in particular exploration and extraction drill holes, with a drill pipe, which at its end facing the floor to be mined is provided with a guide point fixed in the longitudinal direction of the drill pipe and a drill head with at least one cutting element. The drill head can be moved in the longitudinal direction of the drill pipe between a top position, in which the guide point projects beyond the at least one cutting element, and a bottom position in which the at least one cutting element is positioned at the same height as the end of the guide point or projects beyond same in the operating direction. When the drill head is in the top position, the drill pipe is moved in the direction of the drill hole to be produced until the guide point by cooperating with the floor fixes it in position. Then the drill head is moved into its bottom position in order to produce the drill hole.

32 Claims, 4 Drawing Sheets

METHOD AND DEVICE FOR DRIVING BORE-HOLES, ESPECIALLY IN THE SEA BED, USING A GUIDE TIP

BACKGROUND OF THE INVENTION

The invention relates to a process and an apparatus for sinking drill holes, in particular for exploration and extraction and drill holes.

Exploration drill holes are made for the purpose of prospecting deposits and should permit the taking of samples of the material present in the deposit. Exploration drill holes are sunk, in particular, when the deposit is located at great depth and/or when water that is present above the deposit, e.g. an ocean or sea, does not permit the sinking of exploration shafts.

Extraction drill holes serve to extract the deposit content from bottom layers. An example of extraction drill holes is the mining of marine sediments with diamond inclusions present on the ocean floor.

The deposits containing the diamonds have generally been formed in front of river mouths in the form of not very thick layers spread out on a rock base. To mine the diamond-containing sediment material, apparatuses are used which are lowered onto the ocean floor from ships on an extendible drill-pipe. Such apparatuses may have drill heads which are designed for drill holes with a large diameter. Several such drill holes are made close to one another so as to be able to extract as much as possible of the diamond containing material.

When the drill head fastened to a drill-pipe which may have a great length encounters the ocean floor, the problem occurs that at the place on the ocean floor where the drill hole is to be made, the drill head of the drilling tool does not penetrate immediately, but tends to slip and move around spiral-shaped in a circle, especially when the ocean floor has even the slightest slope.

DESCRIPTION OF THE RELATED ART

To prevent this slipping sideways of the drill head, it is already known to arrange a centering guide point underneath the drill head, which under the drilling force exerted in the operating direction of the drill head penetrates into the surface of the sediment layer and, in particular in the initial phase of the drilling, provides a guidance that prevents a slipping sideways of the drill head at the start of the drilling operation, i.e. when the drill head is not yet guided at is sides by the drill hole walls.

When the drill head has passed nearly completely through the sediment layer, the projecting guide point is the first to encounter the generally rocky base located underneath, into which it cannot penetrate or only very slowly and with great wear. The drill head than cannot penetrate further into the sediment layer.

As the profitability of the extraction process depends on the quick sinking of a large number of adjacent drill holes, the respective drilling operation until now is greatly delayed when the guide point encounters the bedrock located underneath the sediment, and accordingly becomes uneconomical.

From the U.S. Pat. No. 3,277,972 an apparatus is known with which the drill head is moved down during the penetrating into a soft sediment layer. The drill head is arranged movable in the drill-pipe direction relative to the housing, so that it can be moved down separately from the housing as soon as the front end of the housing encounters a layer of hard rock.

From the AT-PS 379 863 a drill-pipe is known, which for the guiding in the drill hole comprises a guide sleeve that partly radially surrounds the drill-pipe, the outside diameter of which guide sleeve corresponds approximately to that of the advancing drill head.

BRIEF SUMMARY OF THE INVENTION

It is the objective of the invention to develop further a process and an apparatus for sinking drill holes, in particular exploration and extraction drill holes, of the described type in such a way that a deposit can mined through less hard rock layers up to the generally rocky primary rock located underneath, without in this case the process becoming uneconomical. Furthermore the apparatus should stand out by an adaptability to the most varying drilling conditions and depths and require the lowest possible production costs.

This problem associated with the process is solved by the subject of claim 1.

According to the invention, a drill-pipe which at its end facing the floor to be mined is provided with a guide point fixed in the longitudinal direction of the drill pipe, is lowered to the place where the drill hole is to be made. When doing so, normally the guide point will penetrate at least slightly into the sediment layer. Next a drill head, which on its side facing the floor has at least on cutting element that can be moved in the longitudinal direction of the drill pipe between a top position, in which the guide point projects beyond the at least one cutting element, and a bottom position in which the at least one cutting element is positioned at the same height as the end of the guide point or projects beyond same in the operating direction, is moved from its top position assumed during the lowering of the drill pipe into its bottom position. Seeing that the guide point has penetrated by a certain amount into the sediment layer, the at least one cutting element of the drill head produces in the sediment layer a drill hole start which will guide the drill head laterally before the guide point assumes a decreasing laterally guiding effect of the drill head. When the drill head penetrates further into the sediment layer, the at least one cutting element is, therefore, positioned on the same plane as the end of the guide point or even moves ahead of same, so that according to the invention drill holes up to the bedrock located underneath the sediment layer can be made without any problems. Seeing that as a rule during the drilling operation the guide point need not penetrate into the rock layer located underneath the sediment layer, its wear is reduced considerably.

With a first variant of the process according to the invention, during the drilling operation the drill pipe is made to rotate around its longitudinal axis and as a result thereof, both the drill head fixed rotationally rigid to the drill pipe and also the guide point fixed rotationally rigid to the drill pipe and also the guide point fixed rotationally rigid to the drill pipe, are made to rotate. With this variant of the process, therefor, a "drilling" of the guide point into the sediment layer takes place.

It may, however, also be advantageous, to drive the drill pipe and to transmit the turning momentum to the rotationally fixed drill head, but not to the guide point which is mounted rotating around the longitudinal axis of the drill pipe. This ensures that the guide point does not rotate in the sediment. It is true that as a result thereof no drilling of the guide point into the sediment layer takes place, but it was found that in many cases an adequate guiding function of the guide point is obtained when it is pushed over a short length into the sediment layer exclusively by the mass bearing on it. As no relative movement takes place between the sediment layer and the guide point, the guide point is subjected to less wear compared to the aforementioned variant of the process according to the invention.

Particularly advantageous is the further development of the process with which the drill pipe is mounted rotationally rigid and the drill head is made to rotate relative to the longitudinal axis of the drill pipe, as by this measure the drive unit normally provided on the side of the drill pipe opposite the drill head side as well as possible complicated rotary transmission lead-throughs can be dispensed with. In this case it is possible to arrange the guide point rotationally rigid on the drill pipe.

However, in the case of a relatively hard sediment layer it may be advantageous to arrange the guide point rotating around the longitudinal axis of the drill pipe and to make it rotate around it longitudinal axis together with the drill head, as this permits a "drilling" of the guide point into the sediment layer in order to increase the initial guiding effect.

In another, particularly preferred variant of the process the guide point is again mounted rotating around the longitudinal axis of the drill pipe, but is only taken along by the drill head when the latter, coming from its top position, assumes a position in which the at least one cutting element of the drill head has at least approximately reached the height of the end of the guide point.

This measure ensures that the guide point, as long as it ensures the guiding of the drill head and cannot penetrate further into the sediment layer, is not subjected to wear caused by an idle rotating in the sediment layer, but when the drill head penetrates deeper into the sediment layer it reliable prevents the formation of a "core" in the area not covered by the at least one cutting element.

With a particularly preferred embodiment of the process the force with which the front end of the drill head rests against the floor to be mined or the drill hole bottom, can be adjusted by at least one buoyancy body provided on the drill head.

The design problem is solved by the apparatus disclosed in claim 8 in that on the end of the drill pipe facing the floor to be mined or the front end of the drill hole, a guide point fixed in the longitudinal direction of same is fastened, and that the drill head can be moved in the longitudinal direction of the drill pipe between a top position, in which the guide point projects beyond the at least one cutting element, and a bottom position in which the at least one cutting element is positioned at the same height as the end of the guide point or projects beyond same in the operating direction of the drill head. With the apparatus according to the invention the guide point, therefore, in the first instance serves to prevent a moving sideways of the drill head when starting the drilling, whereas after the drill head has been lowered relative to the drill pipe to behind the plane defined by the at least one cutting element, it lags behind and cannot obstruct the drilling operation by impacting on a rock base or rocky inclusions as caused by a moving ahead.

With the apparatus according to the invention it is possible to make the drill head rotate in the known manner in that the one end of the drill pipe is mounted rotating around its longitudinal axis and the use of a power-driven rotary head, which in the area of this end cooperate with the drill pipe, is provided. In this case the drill head must be arranged rotationally rigid on the drill pipe.

As in many cases, to guide the drill head it will suffice when at the beginning of the drilling operation the guide point is just pushed into the sediment layer, to reduce the wear of the guide point it may be advantageous to mount it on the drill pipe rotating around the longitudinal axis of same.

However, it is particularly advantageous when the end of the drill pipe facing away from the drill head it mounted rotationally rigid on the installation for mounting the drill pipe.

Particularly suitable for such a mounting is a cardanic suspension.

In this case the drill head is preferably made to rotate relative to the drill pipe around the longitudinal axis of the latter by means of a drive unit provided for same.

The drive unit advantageously comprises a rotary motor which cooperates with a device arranged on the drill pipe for receiving a turning momentum, which is provided preferable in the form of longitudinal teething.

The rotary motor may be a hydraulic motor.

However, it is also possible to use an electric motor as the rotary motor.

Tests have shown that in certain sediment layers the guiding effect of the guide point is sufficient when, without it rotating around its longitudinal axis, it is just pushed into the sediment layer, but other sediment layers require a rotating of the guide point around it longitudinal axis. It, therefore, is advantageous, to mount the guide point on the drill pipe rotating around the longitudinal axis of same and to provide on the guide point entrainers which can be made to engage with counter-entrainers provided on the drill head.

Preferably the entrainers and counter-entrainers consist, in the case of the entraining of the guide point, of longitudinal teeth that engage into one another.

It was found, however, that for sediment layers an embodiment of the apparatus is very suitable, with which the entrainers and counter-entrainers engage independent of the position of the drill head, related to the longitudinal direction of the drill pipe.

Particularly suitable for other sediment layers, however, is an apparatus where the entrainers and/or the counter-entrainers are designed in such a way that the guide point is only engaged with the rotating drill head when the at least one cutting element is positioned at the same height as the end of the guide point or projects beyond same in the operating direction of the drill head. This measure ensures that a further lowering of the drill head into the sediment layer is not prevented by a "core" formed in the area not covered by the at least one cutting too.

In a preferred embodiment the longitudinal teething forming the entrainers and counter-entrainers is provided only on the bottom part of the guide point, the counter-teething only in the upper part of the drill head, in such a way that when the drill head is moved along the drill pipe in the direction of the guide point, the upper end of the teething engages with the bottom and of the counter-teething when the at one cutting element has nearly reached the height of the end with the guidepoint.

A particularly good adaptability of the apparatus to different sediment layers is obtained when at least one buoyancy body is provided on the drill head for adjusting the drilling force acting in the operating direction of the drill head. By this measure the drilling force acting in the operating direction of the drill head can adapted to the properties of the sediment layer in question, without causing a change in the force with which the guide point is pushed against the sediment layer. Thus it is possible, in particular in the case of very hard sediment layers, to press the guide point into the layer with great force so as to achieve an adequate guiding effect, but at the same time to regulate the drilling force in such a way that the engaging of the at least one cutting element does not cause a slipping sideways of the drill hole, whereas on the other hand an optimum drilling progress is achieved.

When the at least one buoyancy body comprises a tank which optionally can flooded or filled with a gas, preferable compressed air, then the drilling force can also be changed during the drilling operation. As a result it is possible, for example, to choose at the beginning of the drilling operation—as long as there still exists the risk of a "drifting" of the drill hole—a lower drilling force, but to increase the drilling force so as to increase the drilling progress as soon as the drilling tool begins to guide itself in the drill hole.

The apparatus according to the invention is preferably used in conjunction with a floating platform for sinking drill holes in the ocean floor, on which platform the end of the drill pipe opposite the drill head end is mounted.

In that case it is particularly advantageous, in order to compensate vertical movements of the platform caused by the ocean swell or tide lift, to split the drill pipe into an upper drill pipe part mounted on the platform and a bottom drill pipe part on which the drill head and the guide point are mounted, wherein the upper and the bottom drill pipe parts engage into one another telescopically in the longitudinal direction of the drill pipe and can be moved relative to one another in such a way that the vertical movement of the platform are compensated without the drilling force experiencing a significant change.

With a preferred embodiment of the apparatus according to the invention, a length-variable force generator, preferably a piston/cylinder unit is provided which is mounted on the one side on the bottom drill pipe part, on the other side on the drill head and with which the length variation takes place in the direction of the longitudinal axis of the drill pipe. By this measure the drill head can be moved relative to the bottom part of the drill pipe without this requiring an activation of the winch provided on the platform and a stressing of the ropes. This is especially advantageous when the drill head is "jammed" in the drill hole, e.g. due to a collapsing of the drill hole walls, seeing that by a corresponding activating of the length-variable force generator the drill head can be moved upwards relative to the guide point which, especially when the drill hole extends through the entire sediment layer, rests on the hard bedrock located underneath. In most cases the drill head can, therefore, also be loosened after a collapsing of the drill hole walls.

This embodiment furthermore makes it possible to adapt the projecting length of the guide point to the conditions corresponding to the properties of the floor.

If on the bottom drill pipe part, preferably near its upper end, at least one buoyancy body is provided, the buoyancy force of which can be controlled, then the force with which the guide point rests on the floor can be adapted to the prevailing conditions. If in this case the drill head is provided with a length-variable force generator, then the drilling force can be increased by the proportionate mass force of the bottom drill pipe part and of the components attached thereto in the axial direction.

DETAILED DESCRIPTION OF THE DRAWINGS

Exemplified embodiments of the invention are illustrated in the drawing, wherein.

DESCRIPTION OF THE PREFERRED EMBODIMENTS

Figure 1:
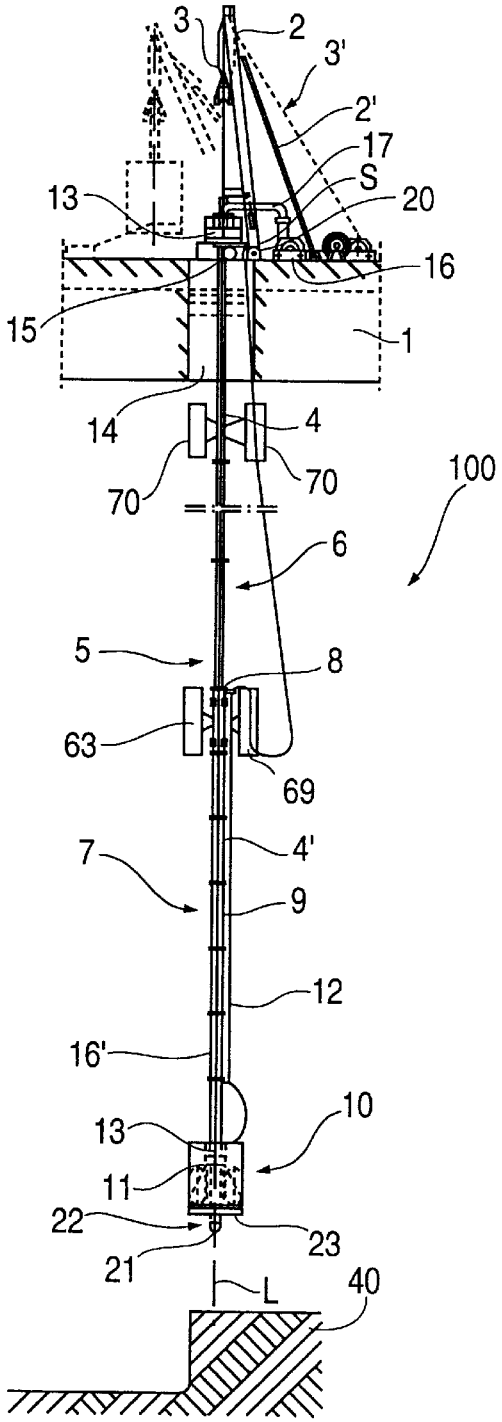
FIG. 1 shows a general view of an apparatus according to the invention, wherein the guide point is positioned above the sediment layer and the drill head has been moved into its top position.
Figure 2:
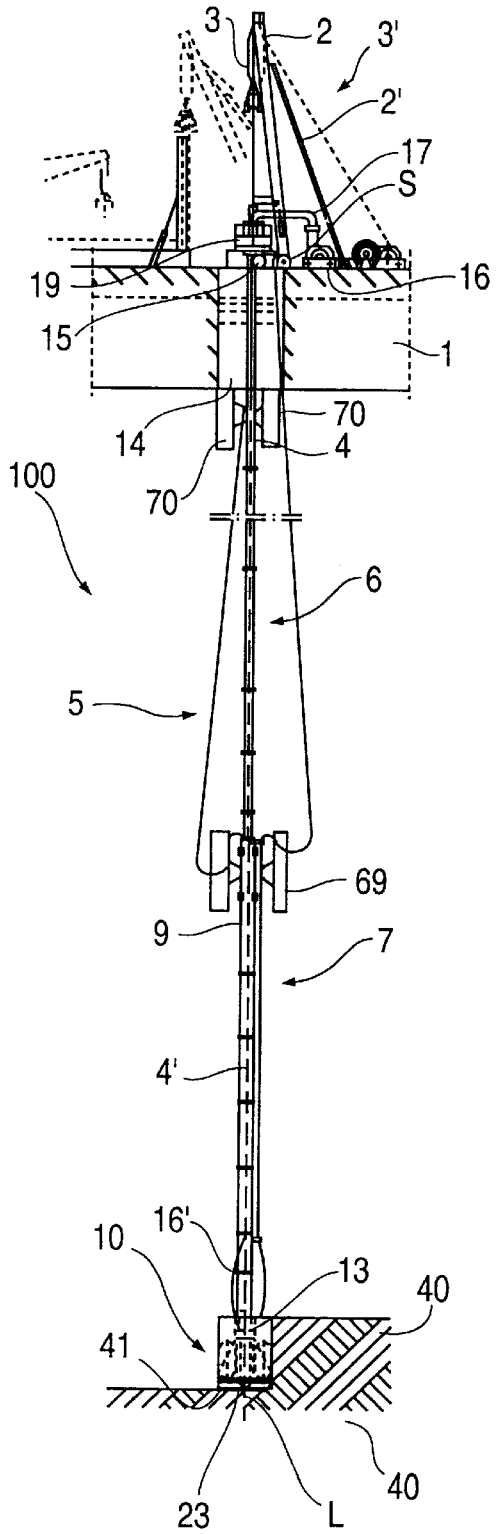
FIG. 2 shows a corresponding general view of the apparatus according to the invention at the end of a drilling operation with the drill head lowered onto the bottom of the drill hole.

The apparatus, which in FIGS. 1 and 2 has been given the overall reference numeral 100, comprises a mast 2 arranged on a floating platform 1, which mast 2 is equipped with a pulley block 3 which serves to lift or lower one or several segments 4, 4' of a drill pipe with the overall reference numeral 5.

The making available of the drill pipe segments 4, 4' to the pulley block 3 is ensured by known devices-only indicated in the drawing-which usually are called "pipe erector" or "pipe handling system". To take over the drill pipe segments 4, 4" the mast 2 is mounted on the platform 1 swiveling around the axis S. The starting of the swiveling movement and the fixing of the mast 2 in its upright position is ensured by a length-variable support 2', of which no further details are shown, which may comprise, for example, a piston/cylinder unit not illustrated in the drawing.

The drill pipe 5 which—as already explained at the outset—consists of detachable segments 4, 4', comprises an upper drill pipe part 6 and a bottom drill pipe part 7. The upper drill pipe part 6 opens out telescopically into the bottom drill pipe part 7 at the point 8 and, as shown in FIG. 1, projects into the same up to about the point 9. The upper and the bottom drill pipe parts 6,7, in the longitudinal section intended for pushing the upper drill pipe part into the bottom drill pipe part, are made in such a away that in this longitudinal section the drill pipe parts 6,7 can move frictionless relative to one another in the longitudinal direction L of the drill pipe 5, but a turning of the two drill pipe parts 6,7 relative to one another around the longitudinal center axis of the drill pipe is not possible.

At the bottom end of the bottom drill pipe part 7 a drill head 10 is arranged, which with the aid of a rotary drive 11 integrated into same can be rotated relative to the drill pipe 5, which in the exemplified embodiment is attached rotationally rigid to the platform and receives the reaction turning momentum. In the illustrated exemplified embodiment a hydraulic motor is used as power source, which by way of a hydraulic line 12 is supplied with pressurized hydraulic fluid. However, it is also possible to use instead of the hydraulic drive an electric drive and to provide instead of the hydraulic line 12 an electric line.

At the upper end of the bottom drill pipe part 7 two buoyancy bodies 69 are arranged positioned opposite one another relative to the axis L, the buoyancy force or displacement volume of which can be controlled.

The rotationally rigid mounting of the upper drill pipe part 6 in the platform 1 is ensured by a cardanic suspension unit 19 ("gimbal") which can be split into two along its vertical center plane, the two halves of which can be separated for the purpose of loosening the respective mounted drill pipe segment 4.

On the upper drill pipe part 6—if required—at least one other buoyancy body 70 is provided (in the illustrated exemplified embodiment two), in order to reduce the load on the suspension device 19 and on a lifting device 3' provided for raising the drill pipe and on the platform 1, respectively, caused by the mass force of the upper drill pipe part 6. Because of this measure the upper drill pipe part 6 can be made longer compared to apparatuses which are not provided with such a buoyancy body, so that exploration drill holes also become possible at greater depths The buoyancy body can again be designed in such a way that its buoyancy volume is variable.

On the drill head 10 two eyes 13 are provided, positioned opposite one another relative to the center axis L of the drill pipe, to which two ropes 16' are fastened, which run through an opening 14 provided in the platform, through which also the drill pipe 5 extends, and via deflecting rollers 15 run to a winch 16. By actuating the winch 16, the bottom drill pipe part 7 can, therefore, be raised and lowered.

In the following, first the basic mode of operation of the illustrated exemplified embodiment of the apparatus according to the invention will be described with reference to FIGS. 1 and 2.

In the phase illustrated in FIG. 1, the drill pipe 5 has already been assembled in its full length by the screwing together of individual segments 4 and 4', respectively. At the upper end of the drill pipe 5, the,pipe elbow 17 for the discharge of raised excavated material is arranged. The upper part 6 of the drill pipe 5 is already mounted rotationally rigid in its operating position on the platform 1 by closing the two parts of the cardanic suspension device 19. The pipe elbow 17 opens out into an inlet 20 with funnel-shaped widened end, which conveys the excavated material to a known device for separating the diamonds contained in the excavated material, which device is not illustrated in the drawing.

In the state illustrated in FIG. 1, the apparatus 100 is positioned in such a way that the drill head is located above the to be excavated spot of the ocean floor 40.

Before the actual drilling operation starts, the winch 16 is eased off, as a result of which the bottom drill pipe part 7, by sliding down the part of the upper drill pipe part 6 projecting into it, is lowered further until the bottom end 21 of a guide point 22 provided at the bottom end of the bottom drill pipe part 7 rests on the ocean floor 40. The resultant mass force of the bottom drill pipe part 7 essentially determines the force with which the end 21 of the guide point 22 rests on the ocean floor 40.

If the platform 1 performs a vertical movement—induced, for example, by the ocean swell or the tidal lift—which depending on the weather may amount to several meters, this will not affect the force with which the guide point rests on the ocean floor 40 or penetrates into same, seeing that the inside drill pipe part 6, corresponding to the vertical movement of the platform 1, can move frictionless into and out of the bottom drill pipe part 7.

To lower the drill head into the ocean floor, first of all the rotary drive 11 is activated, as a result of which—as will still be explained further on—either only the drill head 10 or the drill head 10 and the guide point 22 are made to rotate around the longitudinal axis L of the drill pipe 5. The drill head 10, which can be moved between a top position illustrated in FIG. 1 and a bottom position in which the front end 23 of the drill head 10 is positioned at least at the same height as the end 21 of the guide point 22, is lowered by a further easing off of the ropes 16', until its front end 23 rests on the ocean floor 40. The end 21 of the guide point 22 which—depending on the properties of the ocean floor—has penetrated more or less deeply into the upper layer prevents, during the start of the drilling operation, a spiral-shaped drifting away of the drill head 10 from the spot intended for the drill hole.

The ropes 16' are now eased off further, so that—as can be noted from FIG. 2 at the end of the drilling operation—they hang slack, so that the resultant mass force of the drill head 10 determines the drilling force with which the drill head 10 rests on the bottom 41 of the drill hole in the longitudinal direction L of the drill pipe 5.

The construction and method of operation of the drill head 10 will be explained in detail with reference to FIGS. 3 to 8.

Figure 3:
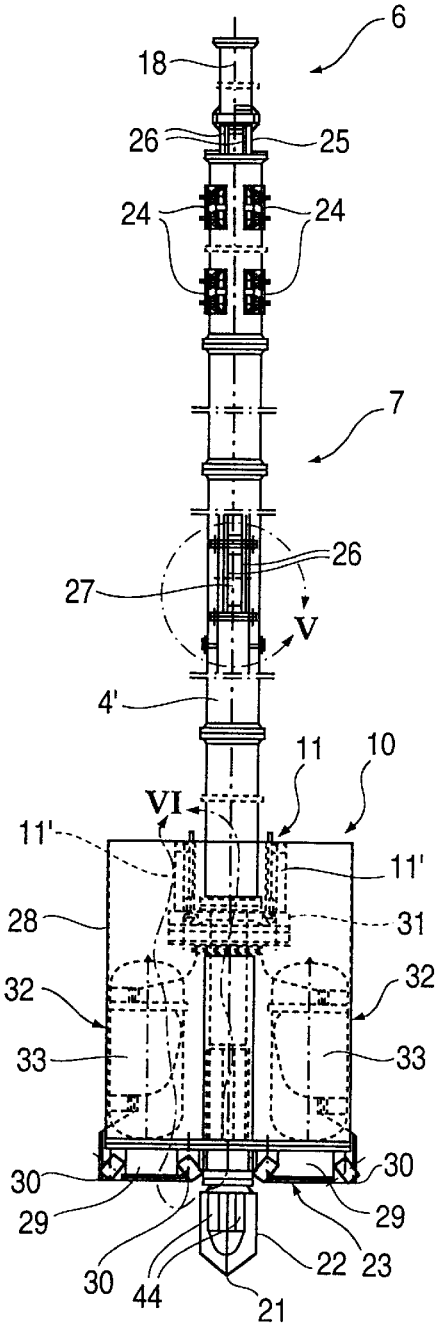
FIG. 3 is an enlarged view of the bottom part of the drill pipe with the drill head in its top position.

FIG. 3 shows and enlarged view of the bottom drill pipe part 7 with the drill head 10 and guide point 22 provided on same. The upper part of the bottom drill pipe part comprises roller arrangements 24 arranged at a distance from one another in the longitudinal L direction of the drill pipe 5, which roller arrangements 24 cooperate with rails 26 arranged on the section 25 of the upper drill pipe part 6 that projects into the bottom drill pipe part 7 in such a way that the upper and bottom drill pipe parts 6, 7 can move frictionless relative to one another in the direction of the longitudinal axis L of the drill pipe 5, but a turning of the two drill pipe parts 6, 7 relative to one another around the longitudinal axis L is not possible.

Figure 5:
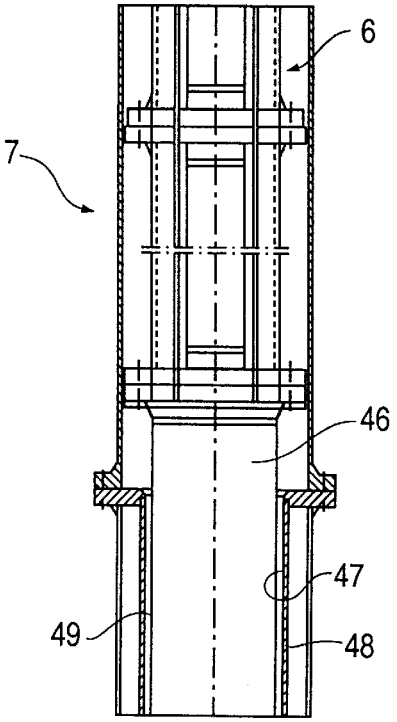
FIG. 5 is an enlarged view of section V in FIG. 4.

As can be noted from the cut-out V illustrated in FIG. 3 seen from below the second segment 4', which in FIG. 5 is shown on a larger scale, the upper drill pipe part 6 has a lateral opening 27, which serves to connect a compressed air supply which—as indicated in FIG. 3—may be in the form of a rigid pressure line 18 arranged on the outer surface of the upper drill pipe part 6. However, it is also possible to realize the compressed air supply through a sagging pressure hose. As this does not restrict the mobility of the two drill pipe parts 6, 7 relative to one another in the longitudinal direction L of the drill pipe 5, it then is possible to provide a lateral opening 27' in the bottom drill pipe part 7, which to the outside opens out into a pipe connection 45 which serves to connect the pressure hose 18' indicated in FIG. 7. The openings 27, 27' are provided to blow in compressed air for the use of the known "air-lift method", with the aid of which the sediment loosened form the ocean floor 40 during a drilling operation, after it gets into the inside of the drill pipe through suitable inlet openings 44 provided in the guide point 22, is conveyed through same to the platform 1.

To prevent that sediment which has entered the drill pipe will penetrate into the mounting between the upper and bottom drill pipe parts 6, 7, and will obstruct the low-friction mobility of the parts relative to one another, at the bottom end of the upper drill pipe part projecting into the bottom drill pipe part 7, and inside pipe 46 ("telescopic pipe") is flanged on, which projects into the part of the bottom drill pipe part 7 positioned underneath same and ends open just above the rotary drive 11 (see FIG. 5). In this area the bottom drill pipe part 7 is made double-walled, the inside wall 47 being formed by an inside pipe 48, the inside diameter of which is dimensioned in such a way that with the outside diameter of the inside pipe 46 it forms a narrow annular gap 49.

As a result of this measure, due to the partial vacuum prevailing in the inside volume of the upper drill pipe part because of the use of the airlift method, the loosened sediment passes through the bottom opening of the inside pipe 46 into the inside of the upper drill pipe part, so that already insofar it cannot come in contact with the roller arrangements 24 or the rails 26. Furthermore, as a result of the partial pressure prevailing inside the upper drill pipe part 6, a certain amount of surrounding water is always sucked up through the annular gap 49 from the upper end of the bottom drill pipe part 7 and the roller arrangements 24 and the rails 26 are rinsed, so that any sediment particles that may have gotten in are always washed out again.

Figure 4:
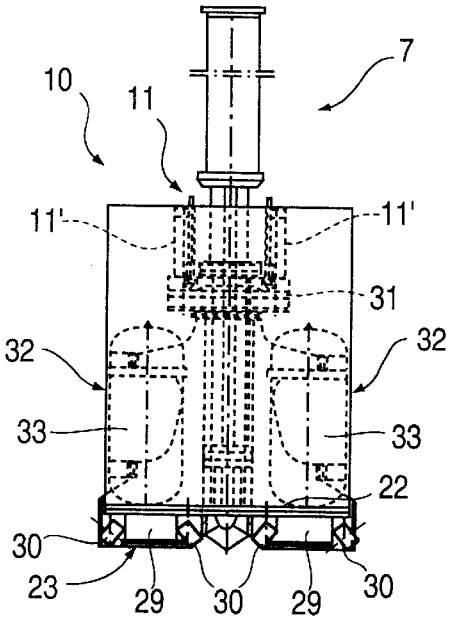
FIG. 4 shows the same drill head as in FIG. 3 in its bottom position.

The drill head 10 illustrated in a general view in FIG. 3 and 4 comprises an essentially cylinder-shaped housing 28 and is provided at its end 23 facing the bottom of the drill hole with cutting elements 29 arranged relative to the longitudinal axis L of the drill pipe 5, which extend radially from the outer periphery of the drill head housing 28 to the outer periphery of the guide point 22. The cutting elements 29 may comprise cutting teeth, cutting teeth and cutting rollers or—as in the exemplified embodiment shown in the drawing—only cutting rollers 30. The cutting elements 29 serve to loosen the ocean floor 40 at the bottom of the drill hole in question.

The rotary drive 11 provided in the upper part of the drill head 10 comprises two hydraulic motors 11', which by means of a transmission arrangement 31 which will still be explained with reference to FIGS. 6 and 7, make the drill head 10 rotate relative to the drill pipe 5 around the longitudinal axis L.

The drill head 10 is furthermore provided, distributed over its periphery, with a number of tanks 33 acting as buoyancy bodies 32, which can optionally be flooded or filled with compressed air with the aid of a compressed air supply not illustrated in the drawing. Preferably, the tanks are fastened to a non-rotating housing part 71 or the drill head 10, as in this case the air supply can take place via simple pressure hoses without a technically complicated rotary seal being required. Because of the resultant possibility of changing the buoyancy, the drilling force acting in the operating direction of the drill head 10, i.e. the force with which the cutting elements 29 for the cutting rollers 30 lie against the bottom 41 of the drill hole, can be adapted to the prevailing conditions. Seeing that—as already mentioned at the outset—the drill head 10 can be moved frictionless on the drill pipe between the top position illustrated in FIG. 3 and the bottom position illustrated in FIG. 4, by changing the buoyancy volume of the buoyancy bodies only the drilling force will be affected, but not the force with which the end 21 of the guide point 22 rests on the ocean floor, so that also at a high buoyancy force and accordingly a low drilling force, the guiding effect of the guide point 22 is not adversely affected. As a result of this construction it is possible, in particular, to keep the drilling force low in the "starting phase", i.e. for as long as the drill does not guide itself in the drill hole, and then, after the self-guiding effect comes into play, the tanks 33 can be flooded to accordingly increase the drilling force so as to ensure a faster drilling.

Figure 6:
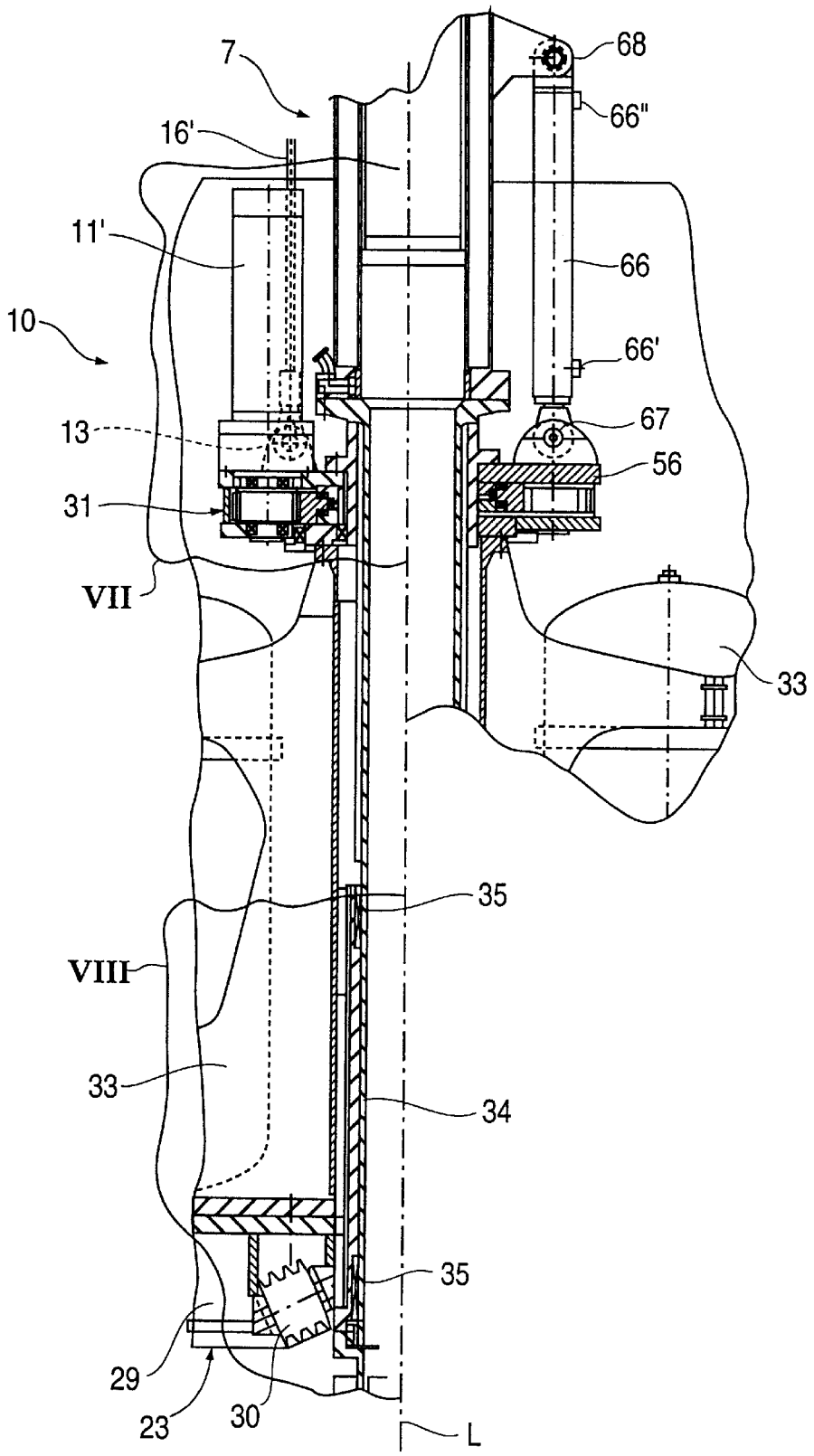
FIG. 6 shows a cut-out of the drill head (cut-out VI in FIG. 3) in an enlarged view.

As can be noted from the right half in FIG. 6, the apparatus comprises a piston/cylinder unit 66. On the piston side the piston/cylinder unit 66 is connected with the aid of a bearing unit 67 to an upper housing part 56, which in turn is fastened to a sliding sleeve 57, the construction and further function of which will be described further on with reference to FIGS. 7 and 8. On the cylinder side the piston/cylinder unit 66 is fastened with the aid of a corresponding bearing unit 68 to the bottom part 7 of the drill pipe 5. The piston/cylinder unit 66 is dimensioned in such a way that the piston has moved completely into the cylinder when the drill head 10 is in its top position illustrated in FIG. 6.

The piston/cylinder unit 66 has two pressure connections 66', 66" provided at the top and bottom cylinder end. When the pressure connection 66" illustrated at the top in the drawing is acted upon by pressurized hydraulic fluid, then the drill head 10 will be moved down relative to the bottom part 7 of the drill pipe 5 and, therefore, also to the guide point 22. By a subsequent supply of pressurized hydraulic fluid to the pressure connection 66', the drill head 10 will accordingly be moved upwards relative to the guide point 22.

The construction makes it possible, in principle, to increase the drilling force with which the drill head 10 rests in its operating direction against the drill hole bottom 41, but normally the drill pipe 5—especially when, as with the present embodiment, it consists of two parts that engage telescopically into one another—is not suitable for absorbing thrust forces. The piston/cylinder unit 66 is, therefore, normally used when the drill head 10 is jammed with its outer surfaces in the drill hole, for example due to a collapsing of the drill hole walls. If in such a case a pressure medium is supplied to the connection 66' of the piston/cylinder unit 66, then the drill head 10 will be moved upwards from it momentary position relative to the guide point 22. As normally there is a hard layer of bedrock underneath the soft sediment layer, the guide point 22 can rest on same, and as a result the drill head 10, with the aid of the force exerted by the piston/cylinder unit 66, is moved upwards in the drill hole. Seeing that, in order to do this, it is no longer necessary to use—exclusively—the winch 16 with the ropes 16' provided on the platform 1, it is prevented that in the case of a jamming of the drill head 10 in the drill hole, the winch 16 or the elements provided on the platform 1 will be overloaded and the lifting device 3' is additionally supported.

Figure 7:
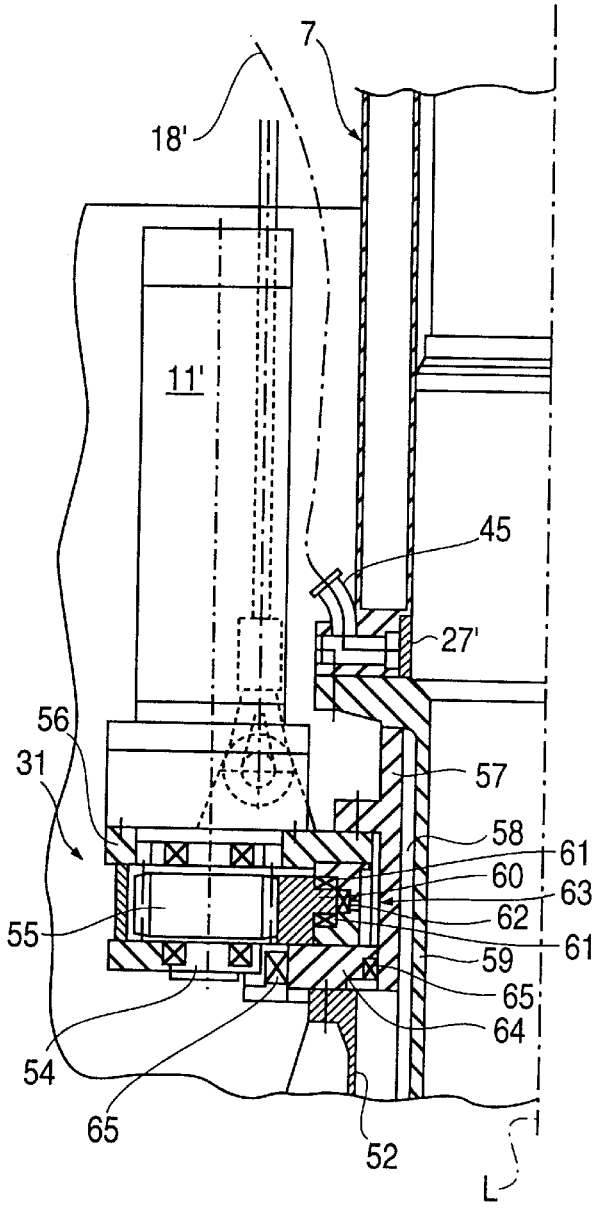
FIG. 7 shows a drive unit for driving the drill head, in a partly cut view (cut-out VII in FIG. 6)
Figure 8:
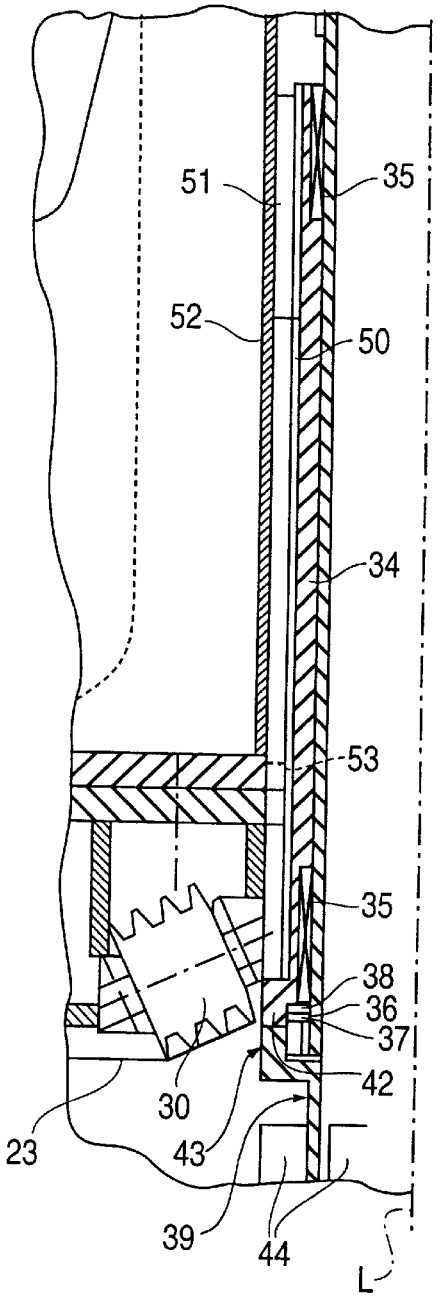
FIG. 8 shows an enlarged cut-out view of the entrainer provided on the guide sleeve and of the counter-entrainer provided on the drill head (cut-out VIII in FIG. 6).

Details of the mounting and the drive of the drill head 10 and of the guide point 22 on the bottom part 7 of the drill pipe 5 are illustrated in FIGS. 6 to 8.

The guide point 22 comprises a tubular guide sleeve 34 open at the top, which is pushed from below onto the bottom end of the bottom drill pipe part 7 and is mounted rotating around the bottom drill pipe part 7 by means of two radial bearing units 35 arranged at a distance from one another in the longitudinal direction L of the drill pipe 5. The axial mounting of the guide point 22 in the direction of the longitudinal axis L is ensured by a circular groove 36 machined into the bottom drill pipe part, into which a radially projecting two-part bearing ring 37 is inserted, on the projecting area of which the guide sleeve is supported, seen in the direction of the drill hole bottom 41, with the aid of a shoulder 38 provided on the guide sleeve. The axial fixing in the opposite direction is ensured by a corresponding counter-shoulder 42, which is provided in a bottom part 39, forming the actual point of the guide point 22, which is screwed to the guide sleeve 34 in a radially projecting circular flange 43.

The guide sleeve 34 had entrainers 50, arranged on its outer periphery , which is the illustrated exemplified embodiment are in the form of longitudinal teething extending over the entire length of the guide sleeve 34. The entrainer 50 engages with a counter-entrainer 51, which in turn is fixed to an inside housing wall 52 of drill head 10. With the exemplified embodiment illustrated in the drawing the entrainer 50 and the counter-entrainer 51 are engaged always—i.e. irrespective of whether the drill head 10 is in its top position illustrated in FIG. 3 or in its bottom position illustrated in FIG. 4. However, to prevent that the guide point 22 is subjected to increased wear in the case of hard sediment layers, it may be advantageous to provide en engaging of the entrainer 50 and counter-entrainer 51 only for positions of the drill head 10 close to its bottom position. Seeing that the counter-entrainer 51 extends over an only short length-related to the longitudinal axis L—as can be seen from FIG. 8, this can be ensured in that—in contrast to the illustrated exemplified embodiment—the entrainer 50 is formed from the all-around flange 43 only up to a certain height, for example up to point 53 in FIG. 8.

To drive the drill head 10, on each of the driving shafts 54 of the rotary motors 11' of the drive 11, of which in FIG. 7 only one is illustrated—by way of example—a gearwheel 55 is provided. The drive motor 11' is flanged rotationally rigid to the upper housing part 56. The upper housing part 56 in turn is connected to a sliding sleeve 57, which can be moved in the direction of the longitudinal axis L, but with the aid of a entrainer-strip 58, with which it is engaged. It is mounted rotationally rigid on a pipe 59 forming the bottom end of the bottom drill pipe part 7.

The gearwheel 55 engages with a driving gearwheel 60, which is mounted rotatable relative to the housing part 56 and the sliding sleeve 57, respectively, with the aid of a bearing arrangement 63, which in order to install the driving gearwheel 60 can be split perpendicularly to the longitudinal axis L and comprises two axial bearings 61 and one radical bearing 62. At its end facing the drill hole bottom 41 the driving gearwheel 60 is connected rotationally rigid to a cover 64, which with the aid of two sealing arrangements 65 seals off the driving gearwheel 60 as well as the bearing arrangement 63 from the surroundings.

Connected rotationally rigid to the side of the cover 64 facing the drill hole bottom 41 is the housing wall 52 of the drill head 10, so that the turning momentum produced by the rotary motor 11' is transmitted to the drill head 10 and makes same rotate relative to the drill pipe 5. The driving of the guide point 22 takes place by way of the entrainer/counter-entrainer arrangement 50, 51 already described above.

What is claimed is:

1. Process for sinking drill holes, in particular exploration and extraction drill holes, comprising:

providing an apparatus having a drill pipe, which at its end facing a floor to be mined includes guide point fixed in the longitudinal direction of the drill pipe and a drill head with at least one cutting element, wherein the drill head can be moved in the longitudinal direction of the drill pipe between a top position, in which the guide point projects beyond the at least one cutting element, and a bottom position in which the at least one cutting element is positioned at the same height as the end of the guide point or projects beyond the same in the operating direction;

moving the apparatus when the drill head is in the top position in the direction of the drill hole to be produced until the guide point, by cooperating with the floor, fixes the end of the drill pipe in position; and moving the drill head into the bottom position in order to produce the drill hole.

2. Process according to claim 1, wherein the drill pipe is made to rotate around its longitudinal axis and the drill head and the guide point are mounted rotationally rigid on the drill pipe.

3. Process according to claim 1, wherein the drill pipe is driven and the drill head is mounted on the drill pipe rotationally rigid, whereas the guide point is mounted on the drill pipe rotating around the longitudinal axis of the drill pipe.

4. Process according to claim 1, characterized in that the drill pipe is mounted rotationally rigid and the drill head is made to rotate relative to the longitudinal axis of the drill pipe.

5. Process according to claim 4, characterized in that the guide point is mounted rotating around the longitudinal axis of the drill pipe and is made to rotate together with the drill head.

6. Process according to claim 4, characterized in that the guide point is mounted rotating around the longitudinal axis of the drill pipe and is entrained by the drill head when the latter, coming from its top position assumes a position in which the at least one cutting element has at least approximately reached the height of the end of the guide point.

7. Process according to claim 1, wherein a force, with which the front end of the drill head rests against the floor to be mined or the drill hole bottom, is adjusted by at least one buoyancy body provided on the drill head.

8. Process according to claim 1, further comprising the step of raising the drill head after reaching the desired depth of a drill hole.

9. Apparatus for sinking drill holes, in particular exploration and extraction drill holes, comprising:

a drill pipe, an installation on which one end of the drill pipe is mounted, a drill head arranged on the other end of the drill pipe, on which in the operating direction of the apparatus at least one cutting element is provided, wherein on the end of the drill pipe facing a floor to be mined, a guide point fixed in the longitudinal direction of the same is provided, and wherein the drill head can be moved in the longitudinal direction of the drill pipe between a top position, in which the guide point projects beyond the at least one cutting element, and a bottom position in which the at least one cutting element is positioned at the same height as the end of the guide point or projects beyond the same in the operating direction.

10. Apparatus according to claim 9, wherein the one end of the drill pipe is mounted rotating around the longitudinal axis of the drill pipe and the installation comprises a device for driving the drill pipe in a rotating motion around its longitudinal axis.

11. Apparatus according to claim 10, wherein the drill head is arranged rotationally rigid on the drill pipe.

12. Apparatus according to claim 11, wherein the guide point is mounted on the drill pipe rotating around the longitudinal axis of the same.

13. Apparatus according to claim 9 characterized in that the one end of the drill pipe is mounted rotationally rigid on the installation.

14. Apparatus according to claim 13 characterized in that the mounting is formed by a cardanic suspension.

15. Apparatus according to claim 14, characterized in that the drill head is provided with a drive unit, by means of which the drill head is made to rotate relative to the drill pipe around the longitudinal axis of the drill pipe.

16. Apparatus according to claim 15, characterized in that the drive unit comprises a rotary motor, arranged on the drill head, which cooperates with a device arranged on the drill pipe for receiving a turning momentum.

17. Apparatus according to claim 16, characterized in that the device for receiving a turning momentum is formed by longitudinal teething provided on the drill pipe, on which the rotary motor is supported to receive the driving momentum.

18. Apparatus according to claim 16, characterized in that the rotary motor is a hydraulic motor.

19. Apparatus according to claim 16, characterized in that the rotary motor is an electric motor.

20. Apparatus according to claim 13, characterized in that the guide point is mounted on the drill pipe rotating around the longitudinal axis of the same and is provided with entrainers which can be made to engage with counter-entrainers provided on the drill head.

21. Apparatus according to claim 20, characterized in that the entrainers and counter-entrainers consist, in the case of the entraining of the guide point, of longitudinal teeth that engage into one another.

22. Apparatus according to claim 21, characterized in that the longitudinal teething provided on the guide point is provided only in the bottom part of the guide point, the counter-teething only in the upper part of the drill head, in such a way that when the drill head is moved along the drill pipe in the direction of the guide point, the upper end of the teething engages with the bottom end of the counter-teething when the at least one cutting element has nearly reached the height of the end of the guide point.

23. Apparatus according to claim 20, characterized in that the entrainers and counter-entrainers are engaged independent of the position of the drill head, related to the longitudinal direction of the drill pipe.

24. Apparatus according to claim 20, characterized in that the entrainers and/or the counter-entrainers are designed in such a way that they are engaged when the drill head is in a position in which the at least one cutting element is positioned at the height of the end of the guide point or in a position in which the at least one cutting element projects beyond the end of the guide point, and are disengaged when the drill head is in its top position.

25. Apparatus according to claim 9, wherein at least one buoyancy body is provided on the drill head for adjusting the drilling force acting in the operating direction of the drill head.

26. Apparatus according to claim 25, wherein the at least one buoyancy body comprises a tank, which can be flooded or filled with a gas, preferably compressed air.

27. Apparatus according to claim 9, wherein the installation on which the one end of the drill pipe is mounted is provided on a floating platform.

28. Apparatus according to claim 27, wherein the drill pipe comprises an upper drill pipe part mounted on the installation on which the drill pipe is mounted and a bottom drill pipe part on which the drill head and the guide point are mounted, wherein the upper and the bottom drill pipe parts engage into one another telescopically in the longitudinal direction of the drill pipe so that they can move relative to one another in such a way that, for example, vertical movements of the platform caused by the ocean swell are compensated without the drilling force experiencing a significant change.

29. Apparatus according to 28, wherein on the bottom drill pipe part at least one buoyancy body is provided.

30. Apparatus according claim 9, wherein a length-variable force generator is provided, which is mounted on the one side on the bottom drill pipe part, on the other side on the drill head and with which the length variation takes place in the direction of the longitudinal axis.

31. Apparatus according to claim 9, wherein on the drill pipe at least one buoyancy body is provided, by means of which the mass force acting on the installation on which the one end of the drill pipe is mounted, can be reduced.

32. Apparatus according to claim 9, wherein the drill head is adapted to be raised after reaching the desired depth of drill hole.

* * * * *